United States Patent [19]

Henc

[11] 4,059,263

[45] Nov. 22, 1977

[54] VACUUM FEED

[76] Inventor: Edward V. Henc, Promisedale Farms R.D. No. 2, Malvern, Pa. 19355

[21] Appl. No.: 693,825

[22] Filed: June 7, 1976

Related U.S. Application Data

[63] Continuation-in-part of Ser. No. 507,494, Sept. 19, 1974, Pat. No. 3,994,489.

[51] Int. Cl.[2] ..... B65H 1/06

[52] U.S. Cl. ..... 271/171; 271/132

[58] Field of Search ..... 271/90, 112, 132, 144, 271/171, 223

[56] References Cited

U.S. PATENT DOCUMENTS

| | | | |
|---|---|---|---|
| 3,486,749 | 12/1969 | Billings | 271/112 |
| 3,661,381 | 5/1972 | Kuzniak | 271/90 |
| 3,923,297 | 12/1975 | Barny | 271/132 |

*Primary Examiner*—Robert W. Saifer

*Attorney, Agent, or Firm*—J. Rodman Steele, Jr.

[57] ABSTRACT

Apparatus for feeding corrugated blanks to processing machinery which comprises roller members mounted above a vacuum chamber which enables each advancing blank to be held flat while minimizing friction between the advancing blank and the feed bed comprised of the rollers. Improved vacuum chamber construction is utilized in which an adjustable back stop includes improved sealing means to minimize vacuum loss.

7 Claims, 3 Drawing Figures

FIG. 1
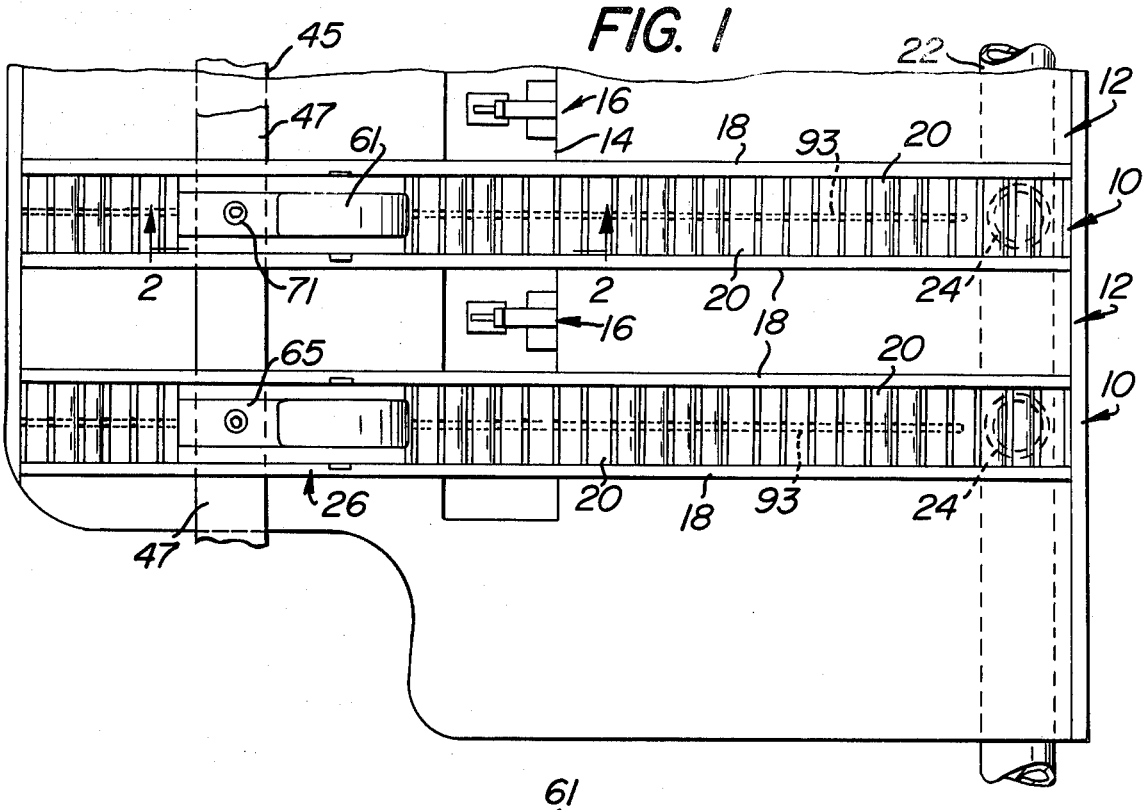
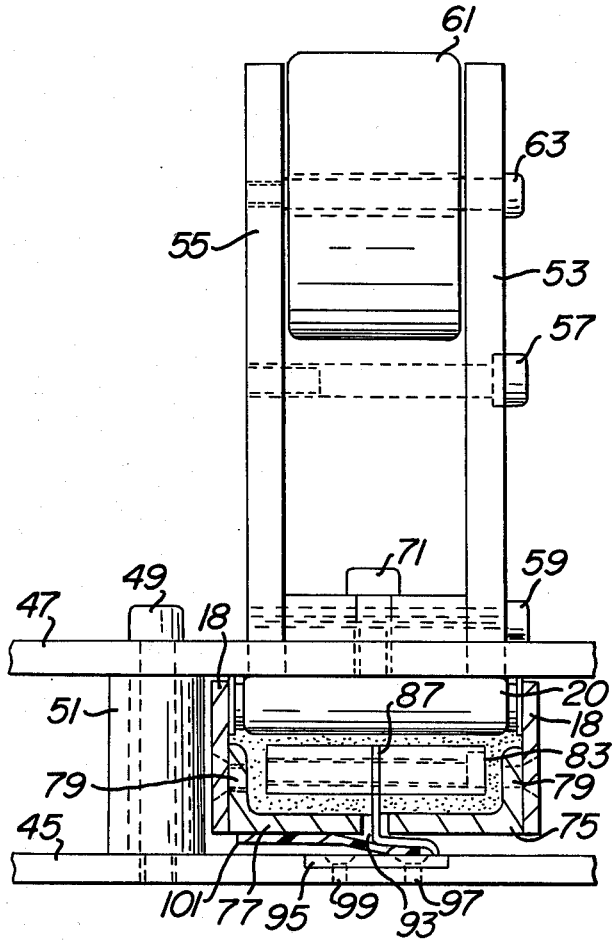
FIG. 3

VACUUM FEED

BACKGROUND OF THE INVENTION

This application is a continuation in part of U.S. application Ser. No. 507,494 filed Sept. 19, 1974, and now U.S. Pat. No. 3,994,489.

The subject invention relates to sheet feeding systems such as those utilized in the corrugated blank feeding industry wherein sheets of material or blanks are stacked and subsequently fed to the processing equipment.

In particular, the subject invention has direct application in feeding systems such as disclosed in co-pending application, now U.S. Pat. No. 3,994,489.

In U.S. Pat. No. 3,994,489 as in similar types of feeding systems, blanks are stacked on feeding equipment preparatory to being fed to processing machinery. The lowermost blank of the stack is engaged by a feed bar and advanced singularly to the processing machinery. Since feeding equipment must accommodate blanks of different sizes and different operation times, an adjustable back stop member is utilized against which the stack of blanks is confined in a position to be engaged in turn by the feed bar mechanism.

As the adjustable back stop is adjusted to different locations dependent upon the size of blanks to be processed, it is also desirable to adjust the vacuum system beneath the feed bed by closing off portions of the vacuum chamber not utilized due to the positioning of the adjustable back stop.

As disclosed in my co-pending application now, U.S. Pat. No. 3,994,489, several different systems for adjusting the vacuum source by effectively adjusting the size of the vacuum chamber are disclosed. In one embodiment, the back stop member was shown being provided with a vacuum close-off member which was lowered to within the chamber to restrict the vacuum to that portion of the chamber above which blanks were being transported. As shown in FIG. 9 of my co-pending application, now U.S. Pat. No. 3,994,489, the vacuum close-off member 126 was a plate-like member extending widthwise across the chamber. A handle 128 which served as a locking member was shown. In another embodiment, in place of the vertical close-off member 126, an extendable roll-out curtain member 132 was shown in FIGS. 10 and 11 which could be extended from a storage roll 134.

While either of these above systems may be utilized, many additional advantages are associated with the use of the improved construction as disclosed in the subject disclosure.

SUMMARY OF THE INVENTION

Accordingly, it is an object of the subject invention to provide in corrugated blank feeding equipment, an improved vacuum system in which an adjustable back stop member can be adjusted without decreasing the efficiency of the vacuum system.

It is a related object of the subject invention to provide in corrugated blank feeding equipment, a vacuum system, adjustable in nature, which is uniquely suited to automation and which does not have to be adjusted by personnel during changes in blank feeding operations.

It is another object of the subject invention to provide an adjustable vacuum system in which a more effective seal can be created without lessening the adjustability of the system.

It is still another object of the subject invention to provide an improved vacuum system for the specific type of rolling vacuum feed table structure as disclosed in co-pending application, now U.S. Pat. No. 3,994,489.

In accordance with the above objects, improved apparatus for feeding sheets or blanks of material from stacks is disclosed herein. The invention in its preferred form is utilized with feeding apparatus such as disclosed in U.S. Pat. No. 3,994,489. In this type of system, vacuum chambers are utilized over which are positioned a plurality of rotatable rollers axially mounted in the direction perpendicular to the travel of blanks of material. A series of chambers are disclosed being located in strip-like fashion with blank engaging means alternatively depressed in strips located therebetween. Adjustable back stop means is disclosed which is positioned to confine blanks of different sizes at different times. Associated with the adjustable back stop means is adjustable structure which serves to redefine the size of the vacuum chamber depending upon the size of blanks being processed, i.e., the positioning of the adjustable back stop means.

More specifically, in the structure of the subject invention , a vacuum chamber is disposed beneath the roller members so that the vacuum supply serves to hold down the lowermost board on the top of the rollers. The chamber is defined by the location of the rollers and is preferably constructed with the rollers forming the top portion of the chamber.

As the back stop member is moved forward or to the rear above the rolling members, a sealing member comprised of flexible material and which is connected to the back stop member moves within the chamber and engages individual roller members in turn to form a tight seal within the chamber. To enable the sealing member to move with the back stop member, the sealing member is connected to structure which moves beneath the vacuum chamber. A linking arm extends from the structure beneath the chamber to the sealing member as permitted by a slot which extends along the base of the chamber. The slot is normally closed by a deflection member which is held in position by the vacuum within the chamber, however, the linking arm must interrupt the closure formed by the deflection member. This linking arm structure associated with the sealing member is positioned remotely from the operation area where the vacuum is utilized and accordingly, the linking arm does not interfere with vacuum supply.

BRIEF DESCRIPTION OF THE DRAWINGS

FIG. 1 is a partial top view disclosing a rolling vacuum feed bed in which the feeding mechanism with the blank engaging means is positioned in alternate strips across the width of the feed bed area;

FIG. 3 is a cross-sectional end view taken along the lines 3—3 of FIG. 2.

DETAILED DESCRIPTION

Figure 2:
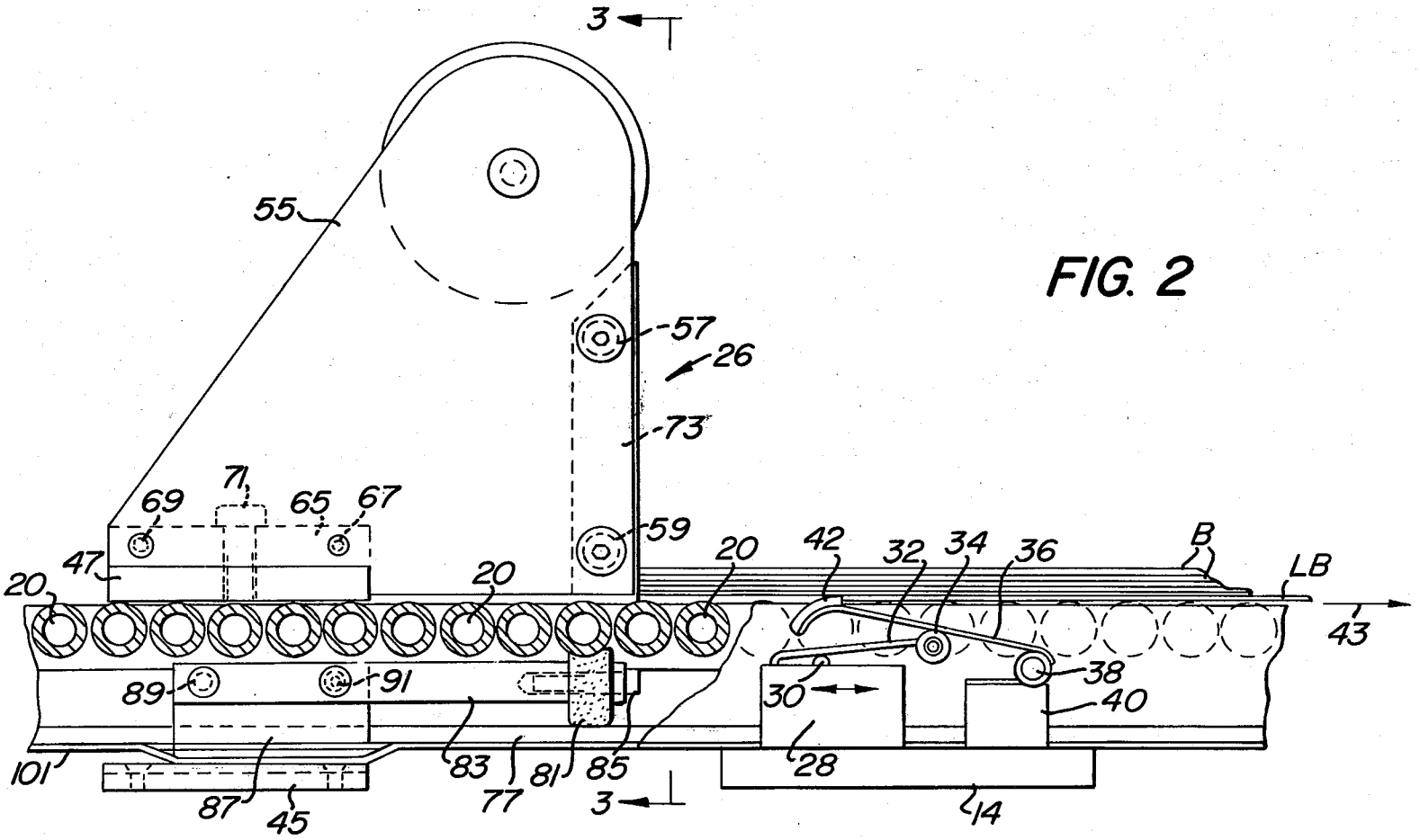
FIG. 2 is a side sectional view taken along the lines 2—2 of FIG. 1.

With reference to FIG. 1, the rolling vacuum feed bed is shown having strip-like divisions positioned across the width of the machine. FIG. 1 is only a partial view, however, it is to be understood that the rolling vacuum feed bed is on the order of that disclosed in my co-pending application, now U.S. Pat. No. 3,994,489.

Alternating vacuum chamber strips 10 are shown with blank advancing means disposed within the remaining strip chamber 12. The blank advancing means comprises a feed bar 14 which extends widthwise across the feed bed yet below the alternating vacuum chambers 10. Blank engaging members 16 are shown mounted on the feed bar 14 which engage the lowermost sheet of a stack of blanks.

The vacuum chambers 10 have side walls 18 within which are mounted rollers 20, mounted to be freely rotatable. A vacuum manifold 22 extends widthwise across the feed bed and is connected to the vacuum chambers 10 via orifices 24. An adjustable back stop mechanism 26 is shown which will be described in detail in subsequent paragraphs.

With reference to FIG. 2, a stack of blanks B are shown with the lowermost blank LB being advanced to processing equipment (not shown). Blank advancing equipment is shown which may be on the order of the air cushioned kicker feed assembly which has been fully described in my U.S. Pat. No. 3,675,918 and which may be positioned as shown in my co-pending application, now U.S. Pat. No. 3,994,489. On feed bar 14, mounted actuator mechanism 28 is shown having a piston projection 30 which engages member 32 joined to rear roller 34. The rear roller 34 engages plate member 36 of a spring finger which is pivotally mounted as shown at 38 on mounting member 40. Both the mechanism 28 and the mounting member 40 are rigidly secured to feeder bar 14. A feed clip 42 is mounted on the curved extremity of plate member 36 and engages the lowermost blank LB.

As can be appreciated by jointly viewing FIGS. 1 and 2, the feeder bar reciprocates with the feeder clips 42 shifting rearwardly of back stop structure 26 in the alternating strips as shown in FIG. 1 to engage the lowermost blank and advance it in the direction of arrow 43 of FIG. 2.

With further reference to FIG. 2 and with reference to FIG. 3, the adjustable back stop structure will now be described in detail. A base plate 45 extends widthwise across the feed bed extending beneath the vacuum chambers (see FIG. 1). A top plate 47 extends widthwise across the machine above the rollers and is secured to the lower plate 45 by adjustment means comprising adjusting bolt 49 which extends through shaft 51. The shaft 51 is shown as a steel roller comprised of frictionless material on the outside. The back stop is secured in position by tightening nut 49.

The back stop is further comprised of upright plate members 53 and 55 which are joined by bolts 57 and 59. A stacking roller 61 is freely rotatable about bolt 63. The side plates 53 and 55 are joined to a cross member 65 by connecting means or bolts 67,69. The cross member 65 along with the upright structure comprising upright plates 53 and 55 is in turn bolted to the top plate 47 by means of bolt 71. In such a manner, the adjustable back stop is firmly secured to top and bottom plates 45 and 47 which when adjusted by adjusting means 49 is secured at desired positions along the vacuum feed table. The front connecting plate 73 extends between plates 53 and 55.

The vacuum sealing means which is connected to the adjustable back stop structure can be seen in FIGS. 2 and 3. It will be noted from FIG. 3 that the vacuum chamber bottom is comprised of angles 75 and 77, the sides of which are secured to chamber sides 18 by screw or rivet means 79. A tight fitting resilient seal member 81 which may be constructed of rubber, neoprene, silicone, or other closed cell material is positioned within the vacuum chamber and abuts tightly against chamber side structure 18 and the sides of angle bases 75 and 77 as well as against the top sides of the bottom portions of angle bases 75 and 77. As shown in FIG. 2, the seal member 81 is resilient and will follow the curvature of rollers 20 at its top portion. The resilient seal member 81 is secured to support structure 83 by screw or other means 85. The support structure 83 in turn is bolted to linking arm or connecting structure 87 of generally angular configuration by means of bolts 89 and 91. The linking arm or connecting structure 87 extends downwardly through a slot 93 which is formed between angle bases 75 and 77. With reference to FIG. 1, it will be noted that the slot 93 is shown terminating near the forward edge of the vacuum chambers. It will be appreciated that the back stop will never have to be adjusted fully to the right since blanks of at least minimal size will always be loaded and accordingly, the slot may be terminated short of the processing equipment. The connecting member 87 terminates in a horizontal cross plate 95 which is secured within base plate structure 45 by means of screws or other means 97 and 99. Also, as best seen in FIG. 3, a deflectable member 101 extends below slot 93 which serves as a sealing closure for slot 93 along those areas where vacuum is being applied. The deflectable member 101 may be a piece of vinyl having good memory characteristics. Thus, as seen in FIG. 2, the chamber is sealed by deflectable member 101 being engaged against the chamber bottom (angle base 75 and 77) beneath and to the right of the sealing member so that the vacuum chamber remains air tight along its base. The vacuum created in the chamber to the right of the seal sucks or draws against deflectable member 101 causing the member 101 to be drawn flush against the chamber bottom structure 75, 77. By this structure, it will be appreciated that the adjustability of the back stop is maintained despite a sealing member 81 being positioned within the vacuum chamber yet connected to the adjustable back stop structure outside of the vacuum chamber. It will be appreciated that the back stop may be moved forward or to the rear to enable blanks of different sizes to be processed once the back stop has been adjusted. In this manner, vacuum will be limited to where it is directed through those rollers 20 serving as a feed bed where it will assist in maintaining the desired level of lowermost board which will be driven to processing equipment by the engaging clip 42 as previously described.

The present invention may be embodied in other specific forms without departing from the spirit or essentail attributes thereof and, accordingly, reference should be made to the appended claims, rather than to the foregoing specification as indicating the scope of the invention.

I claim:

1. Apparatus for feeding blanks of sheet material to processing machinery comprising:

a feed bed for supporting a stack of blanks;

means to drive the lowermost blank of said stack to said processing machinery;

vacuum means to control alignment of the lowermost blank, said vacuum means being positioned beneath said feed bed and including a vacuum chamber of fixed size; and an adjustable backstop member to be adjusted according to the size of blanks being processed including means adjustable along with said backstop member to create a seal between said feed bed and adjacent structure of said chamber, said adjustable sealing means serving to partition said chamber at different intervals as determined by the size of blanks being processed.

2. Apparatus for feeding blanks of sheet material to processing machinery comprising:

roller members axially positioned to rotate in the direction of travel of said blanks as said blanks are moved to said processing machinery, said roller members serving as a feed bed for supporting a stack of blanks;

means to drive the lowermost blank of said stack to said processing machinery;

vacuum means to control alignment of lowermost blank, said vacuum means being positioned beneath said roller members and including a vacuum chamber; and an adjustable back stop member to be adjusted according to the size of blanks being processed including sealing means adjustable with said back stop member to create a seal extending from a portion of the surface of one of said roller members to adjacent structure of said chamber.

3. The apparatus of claim 2 wherein said sealing means is a deformable, resilient member capable of assuming in part the curvature of said rollers to enable the formation of effective seals therewith.

4. The apparatus of claim 2 wherein said adjustable back stop includes a base member adjustable with said back stop beneath said vacuum chamber and wherein said vacuum chamber has a slot therein, said apparatus further comprising connecting means extendable through said slot joining said base member and said sealing means and a deflectable member serving to prevent the loss of vacuum through portions of said slot in said vacuum chamber.

5. The apparatus of claim 4 wherein said sealing means is positioned beneath and in close proximity to that surface of said back stop against which said blanks abut, and wherein said connecting means extends through said slot at a position remote from the location of said sealing means to permit said deflectable member to prevent the loss of vacuum in the proximity of said sealing means.

6. The apparatus of claim 4 wherein said sealing means is secured to a support member which in turn is secured to said connecting means.

7. The apparatus of claim 2 wherein said adjustable back stop member has a lateral plate positioned above said roller members and further has a lateral base plate positioned below said vacuum chamber with said two plates being secured by clamping means which serves to lock the adjustable back stop member in a desired position.

* * * * *